United States Patent [19]

Koczak et al.

[11] Patent Number: 4,808,372

[45] Date of Patent: Feb. 28, 1989

[54] IN SITU PROCESS FOR PRODUCING A COMPOSITE CONTAINING REFRACTORY MATERIAL

[75] Inventors: Michael J. Koczak, Philadelphia, Pa.; K. Sharvan Kumar, Baltimore, Md.

[73] Assignee: Drexel University, Philadelphia, Pa.

[21] Appl. No.: 821,755

[22] Filed: Jan. 23, 1986

[51] Int. Cl.[4] ..... C22C 32/00

[52] U.S. Cl. ..... 420/457; 75/68 R; 420/488; 420/528; 420/552; 420/590; 501/87; 501/89; 501/92; 501/96

[58] Field of Search ..... 420/528, 552, 590, 457, 420/488; 75/68 R; 501/87, 89, 92, 96

[56] References Cited

U.S. PATENT DOCUMENTS

| | | | |
|---|---|---|---|
| 2,826,494 | 3/1958 | Drummond | 420/590 |
| 3,515,542 | 6/1970 | Larsen | 420/590 |
| 4,402,744 | 9/1983 | Sara | 75/239 |
| 4,539,141 | 9/1985 | Brun et al. | 501/87 |

FOREIGN PATENT DOCUMENTS

| | | | |
|---|---|---|---|
| 169030 | 10/1982 | Japan | 420/590 |
| 939578 | 6/1982 | U.S.S.R. | 420/552 |

OTHER PUBLICATIONS

V. N. Eremenko et al., *Liquid Phase Sintering* (Consultant's Bureau, NY 1970) 37–41, 45–46.

H. J. Goldschmidt, *Interstitial Alloys* (Plenum Press, NY 1967) 88–89, 92–99, 196–205.

A. Kelly et al., *Strengthening Methods in Crystals* (Applied Science Pub. Ltd., London 1971) 615–621.

S. F. Exell et al., *Fine Particles,* (2d Int.'l Congress, The Electrochemical Soc., Princeton, NJ 1974) 165–178.

G. W. Halldin et al., *Progress in Powder Metallurgy* 1982 38 (Metal Powder Inds. Fed. Princeton, NJ 1983) 593–611 (abstract).

D. J. Kenton, *Fine Particles* (2d Int.'l Congress, The Electrochemical Soc., Princeton, NJ 1974) 308–330.

L. F. Mondolfo, *Aluminum Alloys: Structure and Properties* (Butterworths, Boston 1976) 335–336, 380–382, 385–388.

*Primary Examiner*—L. Dewayne Rutledge
*Assistant Examiner*—Robert L. McDowell
*Attorney, Agent, or Firm*—Panitch, Schwarze, Jacobs & Nadel

[57] ABSTRACT

An in situ process is provided for producing a composite comprising a refractory material dispersed in a solid matrix. A molten composition comprising a matrix liquid, and at least one refractory carbide-forming component are provided, and a gas is introduced into the molten composition. A reactive component is also provided for reaction with the refractory material-forming component. The refractory material-forming component and reactive component react to form a refractory material dispersed in the matrix liquid, and the liquid composite is cooled to form a solid composite material. In one embodiment, the reactive component is a carbonaceous component in the form of a component of the gas, a solid in the gas or the molten composition, or both. The carbonaceous component is provided for reaction with a refractory carbide-forming component to yield a refractory carbide. In a preferred embodiment, the matrix liquid is molten aluminum and the refractory carbide-forming component is tantalum. In other embodiments, refractory borides or refractory nitrides are formed in situ in the matrix liquid.

43 Claims, No Drawings

IN SITU PROCESS FOR PRODUCING A COMPOSITE CONTAINING REFRACTORY MATERIAL

STATEMENT OF GOVERNMENT INTEREST

The present invention was made in part under U.S. Government Contract No. 62269-81-C-0743 from the Naval Air Development Center. The Government has certain rights in this invention.

FIELD OF THE INVENTION

The present invention relates to an in situ process for producing a composite of a refractory material dispersed in a matrix material. More particularly, the invention relates to an in situ process for producing a finely dispersed refractory material in a matrix material to improve the mechanical properties and wear resistance of the matrix.

BACKGROUND OF THE INVENTION

"Refractory materials" include refractory carbides, borides and nitrides. Refractory materials are characterized by relatively high melting temperatures and hardness, and relatively low chemical reactivity in comparison with non-refractory materials.

Refractory carbides include those transition metal carbides known as interstitial carbides, and the covalent carbides. Interstitial carbides and covalent carbides are collectively referred to herein as "refractory carbides" to distinguish them from carbides formed by the metals of Groups I, II and III of the periodic chart of elements, which form salt-like carbides. Refractory carbides are also to be distinguished from those carbides formed by transition metals having atomic radii smaller than about 1.3 angstroms, such as chromium, magnesium, iron, cobalt and nickel, which do not form typical interstitial carbides.

Interstitial carbides are carbides formed by transition metals having atomic radii of about 1.3 angstroms or greater. In interstitial carbides carbon atoms occupy the interstices between the metal atoms. The characteristic properties of the metal are not fundamentally altered by interstitial carbide formation. Yet the metallic lattice is stabilized, thus increasing hardness and raising the melting point of the composite containing the carbide in comparison with the metal. Transition metals which form refractory carbides include niobium, tantalum, titanium, zirconium, hafnium, molybdenum, vanadium and tungsten.

The covalent carbides are silicon carbide and boron carbide.

Refractory borides include those transition metal borides known as interstitial borides. Interstitial borides include, for example, titanium boride, tantalum diboride, zirconium diboride, and hafnium boride. Refractory nitrides include interstitial nitrides formed by transition metals such as zirconium nitride, titanium nitride, tantalum nitride, and hafnium nitride, as well as refractory covalent nitrides such as boron nitride and silicon nitride. Transition metals form interstitial boride and nitrides which are analogous to the interstitial transition metal carbides in their extreme hardness, chemical inertness and high melting temperature.

Fine particles of refractory carbides are useful in strengthening matrix materials. For example, a titanium carbide particulate has been used to improve the mechanical properties of aluminum. G. W. Halldin et al., *Progress in Powder Metallurgy*, 38 (1983) 593–611. The wear resistance of sintered aluminum alloy is improved by the addition of two weight percent of titanium carbide. Wear resistance increases with increasing carbide content up to about eight weight percent titanium carbide.

Other composite materials formed from relatively hard particles dispersed in a relatively soft matrix are known in the art. For example, U.S. Pat. No. 4,402,744 discloses composite materials of carbon particles in an aluminum matrix. In addition to the aluminum matrix and the particulate or fibrous carbon, a third component is included in forming the composite. The third component is a powder of an intermetallic compound of aluminum and tantalum, aluminum and titanium, or aluminum and hafnium. For example, the intermetallic compound may be tantalum aluminide, titanium aluminide, or the like. The ratios of aluminum to carbon, and aluminum to tantalum or titanium, are chosen so that heating the mixture under pressure ("sintering") will yield an aluminum alloy composite having an aluminum matrix in which carbon particles and a refractory carbide selected from titanium, tantalum or hafnium carbide, are dispersed (column 9, line 49–column 11, line 10 and Examples XI, XIV and XX).

The composite materials of this patent have good frictional and strength properties and are useful for applications such as rotary seals in automotive applications, aerospace components and the like. The refractory carbides formed by titanium, tantalum and hafnium are believed to help bond the aluminum matrix to the carbon particles dispersed in the matrix. The process for producing the composite materials disclosed in U.S. Pat. No. 4,402,744 requires that carbon particles, aluminum powder, and a powdered intermetallic compound of aluminum and the refractory carbide forming metal, be moldèd at elevated temperature and pressure to give the composite material.

The sintering of powdered refractory carbides in the presence of a liquid phase nonferrous matrix or binder is used to prepare abrasives commercially, and has been closely studied. For example, the densification processes which occur during sintering of composite materials formed from nickel and titanium carbide, cobalt and titanium carbide, and cobalt and tungsten carbide, have been investigated. V. N. Eremenko et al. Liquid Phase Sintering (Consultants Bureau, New York 1970) 37–46. In abrasive composites, the carbides often form a substantial proportion by weight of the composite.

Fine powders of refractory carbides may be prepared by gas phase reaction of a metal chloride, such as titanium tetrachloride, with methane in a hydrogen plasma. S. F. Exell et al., "Preparation of Ultra-Fine Powders of Refractory Carbides in an Arc-Plasma," *Fine Particles* (Second Int.'1 Conf., The Electrochemical Soc., Inc., Princeton, N.J. 1974) 165–177.

SUMMARY OF THE INVENTION

The present invention provides an in situ process for producing a composite with improved homogeneity comprising a refractory material dispersed in a matrix. A molten composition comprising a matrix liquid, at least one refractory material-forming component, and a reactive component for reaction with the refractory material-forming component are provided; and a gas is introduced into the molten composition. The refractory material-forming component reacts with the reactive component in the matrix liquid to form a liquid composite comprising a refractory material dispersed in the matrix liquid. Subsequently, the liquid composite is cooled to form a solid composite material. Preferably, the gas is introduced into the molten composition under an inert atmosphere.

The refractory material may comprise a refractory boride, formed from the reaction of a refractory boride-forming component with a boron-containing component. Similarly, the refractory material may comprise a refractory nitride, formed from the reaction of a refractory nitride-forming component with a nitrogenous component. Further, the refractory material may comprise a refractory carbide, formed from the reaction of a refractory carbide-forming component with a carbonaceous component.

The gas may comprise the refractory material-forming component, the reactive component, both the refractory material-forming component and the reactive component, or neither component.

In a preferred embodiment of the present invention, the gas comprises a carbonaceous component. Preferably, in addition to the carbonaceous component, the gas comprises an inert carrier or diluent gas, such as argon. It is also preferred that the carbonaceous component be a carbonaceous gas such as carbon monoxide, carbon dioxide, mixtures thereof, or methane.

In another embodiment of the present invention, the carbonaceous component comprises a carbonaceous solid suspended in the gas which is introduced into the molten composition.

In one embodiment of the present invention, the molten composition comprises the refractory material-forming component and the reactive component in addition to the liquid matrix. In this embodiment the gas includes an inert gas which may also include additional reactive component.

For example, in one embodiment of the present invention, the molten composition contains elemental carbon in addition to the matrix liquid and a refractory carbide-forming component, and an inert gas is introduced into the molten composition to agitate the molten composition.

In yet another embodiment of the present invention the gas comprises a carbonaceous component and the molten composition contains elemental carbon.

It is preferred that the matrix liquid comprise a liquid metal which forms a refractory material having a Gibbs free energy of formation greater (less negative) than about −10 kilocalories per mole. Molten aluminum is especially preferred as a matrix liquid. It is also preferred that the refractory carbide-forming component be selected from niobium, tantalum, titanium, zirconium, hafnium, molybdenum, vanadium, tungsten, boron, and silicon.

When the refractory material-forming component is a transition metal, it is preferred that at least a part of the total amount of refractory material-forming transition metal be dissolved in the matrix liquid.

DETAILED DESCRIPTION

The process of the present invention provides composite materials (i.e. "composites") having a fine particulate phase, comprising a refractory material, dispersed in a matrix material. The process provides composite materials having high modulus, mechanical strength and wear resistance, in comparison to the matrix material without the refractry material. In addition, the process of the present invention provides composite materials having reduced gravity separation (i.e. improved homogeneity) of the component phases in comparison with composites produced by prior art processes. Tool surfaces may be coated with compositions prepared according to the present process to increase wear resistance, to provide an abrasive coating, or both. For example, composites of a refractory carbide dispersed in a nickel-titanium or nickel-copper alloy may be used to coat tool surfaces.

Further, in a preferred embodiment the process of the present invention provides composite materials comprising a refractory carbide dispersed in an aluminum matrix, the composite material being substantially free of aluminum carbide. Aluminium carbide is undesirable in alloy compositions because it is reactive with atmospheric water vapor.

Unlike prior art processes, which require that a powder of a refractory material such as a refractory carbide be blended with the matrix solid prior to sintering or forming a molten composition containing the refractory material, the process of the present invention provides in with formation of refractory materials within a liquid matrix material, such as molten aluminum.

The matrix material which is used in the process of the present invention to produce a composite material may be any metallic or ceramic material which does not react with the reactive component to form a refractory material such as an interstitial or a covalent carbide. When the matrix liquid is a liquid metal, the Gibbs free energy of formation of the product formed by the liquid metal and the reactive component is greater than about −10 kilocalories per mole. This criterion indicates that reaction of the reactive component and the matrix liquid is not substantially favored thermodynamically in comparison to reaction of the reactive component and the refractory material-forming component of the molten composition.

The matrix liquid may be molten aluminum or a molten alloy thereof. Other molten nonferrous metallic materials may also be used. For example, the matrix liquid may be a molten alloy of copper and nickel or an alloy of beryllium or magnesium. The matrix liquid and the refractory carbide-forming component are preferably chosen so that the refractory material-forming component is at least partially soluble or highly dispersible in the matrix liquid.

Ceramic materials may also be used as the matrix liquid. For example, ceramic materials comprising molten silicon dioxide may be used.

As indicated above, when the refractory material-forming component forms a refractory carbide, the refractory carbide-forming component may comprise any element which forms an interstitial carbide or a covalent carbide. Similarly, when the refractory material-forming component is a refractory boride- or nitride-forming component, the refractory boride- or nitride-forming component may comprise any element which forms an interstitial boride or nitride or a refractory covalent boride or nitride.

Thus, the refractory material-forming component may be a free element, such as tantalum, titanium, niobium, or the like; or an intermetallic compound such as tantalum aluminide, titanium aluminide, or the like. Alternatively, the refractory material-forming component may be a non-carbide, boride or nitride compound, such as titanium hydride, hafnium hydride, silicon tetrachloride or the like. Similarly, the refractory material-forming component may be a metallic alloy, such as an alloy of tantalum or titanium.

The refractory material-forming component and the matrix liquid may form a single phase, or the refractory material-forming component may form a distinct phase dispersed in the matrix liquid phase. Additionally, the refractory material-forming component may form a distinct phase dispersed in the matrix liquid and simultaneously be solubilized to a limited extent in the matrix liquid.

The refractory material-forming component may be dispersed as a solid in the matrix liquid. For example, intermetallic compounds such as titanium aluminide and tantalum aluminide may be dispersed in a molten aluminum matrix liquid. The titanium or tantalum aluminide may in turn dissolve to a limited extent in the molten aluminum, yielding a solution of the refractory material-forming metal in liquid aluminum.

The phase composition of the molten composition may be determined from the weight composition of materials charged and the phase diagram of the components. For example, when the matrix liquid is a molten metal, such as molten aluminum, and the refractory carbide-forming component is an interstitial carbide-forming transition metal, such as tantalum, the phase composition of the system may be obtained by referring to a binary phase diagram. Phase diagrams of many bimetallic compositions are available in L. F. Mondolfo, *Aluminium Alloys: Structure and Properties* (Butterworths, Boston 1976). The phase diagrams for the aluminum-niobium system (page 335), the aluminum-tantalum system (pages 380–381), and the aluminum-titanium system (pages 385–388) are incorporated herein by reference.

The quantity of refractory material-forming component included in the liquid matrix depends on the solubility of the refractory material-forming component in the matrix liquid, the dispersibility of any insoluble phase comprising the refractory carbide-forming component in the liquid matrix, and, ultimately, the physical, thermal and mechanical properties desired in the product.

Molten compositions comprising a matrix liquid and a refractory material-forming component may be provided, for example, by heating a blend of a powder of the matrix solid and a powder of a solid comprising the refractory material-forming component. For example, aluminum powder and titanium aluminide powder may be blended and heated. Alternatively, the blend may contain aluminum powder and powdered tantalum, or the like. Further, a molten composition may be provided by heating a powder of an alloy containing a matrix liquid-forming component and a refractory material-forming component. The solid matrix material may take the form of a powder, pellets, an ingot or the like.

The blend may be heated in an inert vessel under an inert atmosphere until the matrix solid melts and becomes the matrix liquid. The refractory material-forming component may dissolve either partially or completely in the matrix liquid. By "inert atmosphere" is meant a vacuum (i.e. $\leqq 0.0001$ torr) or an atmosphere of an inert gas such as argon, helium or the like. By "inert vessel" is meant a vessel which is substantially noneactive with the matrix liquid and with the refractory material-forming component of the molten composition.

Alternatively, the refractory material-forming component may be introduced continuously or periodically into the matrix liquid. For example, when the matrix liquid is molten aluminum and the refractory material-forming component is tantalum, tantalum wire may be fed into the molten aluminum to periodically replace tantalum consumed by reaction with the reactive component in forming the refractory material.

The matrix solid may be melted by any means known in the art. For example, the matrix solid may be melted by the action of electrical induction coils of an induction furnace, or the like.

Preferably, convection currents in the molten composition contained in the inert vessel aid in suspending solid phase particulates, such as a solid particulate of an intermetallic compound, in the matrix liquid. Mechanical agitation, such as provided by mechanical stirrers and the like, may also be used to aid in suspending solid phase particulates in the molten composition.

In one embodiment of the present invention, a gas comprising a reactive component is introduced into the molten composition. The gas may be introduced into the molten composition by bubbling the gas through the molten composition. For example, a tube may be positioned within the molten composition below the surface of the molten composition. The gas may be supplied through the tube. Preferably, the bottom end of the tube is positioned near the bottom of the vessel within which the molten composition is contained. Alternatively, the gas may be supplied through the bottom of the vessel containing the molten composition. The gas aids in suspending particulate solids, such as refractory materials and intermetallic compounds, in the molten composition.

The tube may have an open end, or it may be provided with a closed end and a plurality of slits proximate the closed end of the tube. Means may be provided for finely dispersing the gas introduced into the molten composition. For example, the end of the tube may be fitted with a screen having a fine mesh.

As the gas is introduced into the molten composition, the refractory material-forming component reacts with the reactive component of the gas to form a fine dispersion of refractory material in the matrix liquid. The rate at which the fine dispersion of refractory material forms may depend on a number of factors, such as the rate at which, and extent to which, the reactive component reacts in the matrix liquid. The ratio of the interfacial area of the gas/matrix liquid and/or the interfacial area of the gas/refractory material-forming component within the molten composition to the volume of the composition may also affect the rate at which the refractory material dispersion is produced.

When the reactive component is more volatile at the temperature of the molten composition than the refractory material-forming component, such as when the reactive component is a carbon oxide and the refractory material-forming component is tantalum, an excess of the volatile component is required to achieve complete reaction of the refractory material-forming component.

The reactive component may be a gas. For example, the reactive component may be a carbonaceous gas selected from carbon monoxide, carbon dioxide, mixtures thereof and methane. Other hydrocarbons such as ethane, propane, butane, pentane and the like, and mixtures thereof, which are volatile at the temperature of the molten composition, may also be employed. Alternatively, other volatile organic compounds may be used as a carbonaceous component. When a refractory nitride is to be prepared, the gaseous reactive component may comprise nitrogen. The gas comprising a reactive component may additionally comprise an inert carrier or diluent gas. The inert carrier gas may be argon, helium, or the like. An inert diluent gas such as argon aids in purging gaseous by-products of the refractory material-forming reaction, such as hydrogen from the reaction of methane and tantalum, from the molten composition. The ratio of inert carrier gas and reactive component is chosen to avoid mixtures known to be explosive. Further, the gas comprising the reactive component may further comprise a reductive component such as hydrogen.

The refractory material-forming component may also be a gas. For example, the refractory material-forming component may be a volatile transition metal halide, such as titanium tetrachloride, niobium pentachloride, or tantalum pentachloride, or a volatile non-transition metal halide, such as silicon tetrachloride. When the gas includes a halide, the gas may also include hydrogen to react with halogen formed as a by-product by the reaction of the transition metal halide and the reactive component.

In another embodiment of the present invention, the refractory material-forming component, the reactive component, or both, may be suspended as a particulate in the gas which is introduced into the molten composition. For example, a fine particulate of elemental carbon, such as lamp black, may be suspended in an argon carrier gas and introduced into a molten aluminum matrix liquid containing dissolved tantalum as the refractory material-forming component. The gas may include a carrier gas in which is dispersed an aerosol of the reactive component. For example, an aerosol of a liquid hydrocarbon may be dispersed in an argon carrier gas.

The temperature at which the gas is introduced according to the process of the present invention depends on the melting point of the matrix solid, the phase composition of the molten composition, and the desired rate of reaction of the refractory material-forming component with the reactive component. The temperature is preferably selected to optimize the reaction between the reactive component and the refractory material-forming component. The temperature, amount of gas, and period during which gas is introduced are preferably jointly selected to provide complete reaction of the refractory material-forming component.

The present invention permits the amount of refractory material-forming component and the amount of reactive component introduced into the molten composition to be varied independently and continuously during their reaction in the matrix liquid to form the refractory material. Thus, a substantial excess of either component in the matrix liquid can be avoided. For example, silicon tetrachloride and methane may be provided in the molten composition by introducing these components as gases into the matrix liquid in which they react to form the refractory material silicon carbide.

In another embodiment, the present invention provides a process for producing a composite material with reduced gravity separation in comparison with composite materials produced by prior-art processes. The extent of gravity separation in a solid composite may be assessed qualitatively by microscopic examination of a vertical section and quantitatively by measuring the density of horizontal sections.

In this embodiment, first, a molten composition comprising a matrix liquid, at least one refractory material-forming component, and reactive component is prepared. For example, the molten composition may be prepared by heating an elemental mixture of the matrix solid, a solid powder of a refractory carbide-forming component, and solid elemental carbon.

The matrix solid may be a solid nonferrous metallic powder, such as powdered aluminum, or an alloy thereof. The solid refractory material-forming component may be a metal powder, such as powdered titanium, tantalum or niobium; or a powdered intermetallic compound of the refractory material-forming component and another metal, such as titanium aluminide, tantalum aluminide, or the like. Alternatively, the solid refractory material-forming component may be a mixture of a powder of the refractory material-forming component, such as a powder of the titanium, and a powder of an intermetallic compound containing the refractory material-forming element, such as titanium aluminide.

When the reactive component is elemental carbon, the elemental solid carbon may be powdered graphite, lamp black, glassy or amorphous carbon, superfine carbon, or the like. Preferably, the solid powders comprising the solid composition are blended together prior to heating. The solid composition may, for example, be heated in an inert crucible, such as an aluminum oxide crucible, under an inert atmosphere. A heating means, such as an induction furnace, is employed to provide the molten composition. Preferably, the matrix liquid wets the surface of the elemental carbon.

The relative quantities of refractory material-forming component and the reactive component are preferably chosen so that the molten composition contains substantially equal amounts, on an equivalent weight basis, of the refractory material-forming component and the reactive component. Preferably, the molten composition is heated for a period sufficiently long so that the reactive component and the refractory material-forming component react substantially completely to form the refractory material. Thus, when the refractory material-forming reaction is substantially complete, substantially all of the refractory material-forming component and the reactive component will have been consumed by the reaction.

While the molten composition is being heated according to this embodiment an inert gas is introduced into the molten composition to agitate the molten composition. The inert gas may be selected from argon, helium, or the like. The inert gas may be introduced into the molten composition by bubbling the gas through the molten composition, as described above. Preferably, introduction of the gas is begun shortly after the solid composition becomes molten and terminated shortly before the molten composition solidifies. The inert gas also serves to help remove by-products of the reaction between the refractory material-forming component and the reactive component from the liquid matrix. For example, the inert gas helps to remove hydrogen formed in the reaction between tantalum and methane to give tantalum carbide.

In yet another embodiment, the present invention provides a process for producing a composite material of refractory material dispersed in the matrix material, wherein a reactive component is included both in the solid composition which is heated to provide the molten composition and in the gas which is introduced into the molten composition. For example, elemental carbon may be included in the solid composition which is heated and methane may be included in the gas. The relative amounts of refractory material-forming component and reactive component in the solid composition are preferably chosen so that the amount of refractory material-forming component is greater than the amount of solid reactive component in the solid composition, on an equivalent weight basis. Preferably, the total amount of the reactive component and the amount of the refractory material-forming component are equal on an equivalent weight basis.

The process of the present invention yields a narrow distribution of refractory material particles having a fine particle size dispersed in the matrix solid. For example, tantalum carbide particles having particle sizes between about 0.5 microns and 4 microns may be prepared in an aluminum matrix by the process of this invention. Preferably, the volume fraction of the refractory material in the solid product composite is between about 0.2 and 0.4. However, when the composite contains a refractory carbide and the composite is used to provide wear-resistant surfaces on tools and the like, the volume fraction of carbide in the composite may be as high as about 0.9.

The invention will now be described in more detail with reference to the following specific, non-limiting examples:

EXAMPLE 1

A molten composition was prepared by melting a mixture of powdered aluminum and powdered tantalum containing 87.94 percent by weight of aluminum and 12.03 percent by weight of tantalum. The aluminum was a 99.9 percent pure powder obtained from Alcoa Corp. The tantalum was 99.9 percent pure 200 mesh powder from GTE Corp.

The mixture was charged to a cylindrical aluminum oxide crucible having a one inch diameter and three inch height to give a cylindrical casting about 0.75 inch in height. The mixture was melted in a Vacuum Industries Series 7 induction furnace, under a vacuum (≦0.0001 torr). A mixture of 90 percent by volume argon (M.G.I. Industries, Valley Forge, Pa., grade U.N. 1006) and 10 percent by volume methane (M.G. Scientific Gases, 98 percent technical grade, U.N. 1971) was premixed and bubbled through the molten composition immersed in the melt at one standard cubic foot per hour for sixty minutes by means of an open ended aluminum oxide tube.

A temperature greater than about 1200 degrees Celsius was maintained in the molten mixture as the gas mixture was bubbled through the molten composition. The temperature of the composition was monitored by a chromel-alumel thermocouple. After stopping the gas bubbling and removing the copper tube, the molten composition was cooled rapidly to solidify it.

The resulting composite material was subjected to microstructural examination by scanning electron microscopy which revealed a resulting precipitate which was homogeneously distributed hrough the section taken. A bimodal particle size distribution was observed, having an average particle size in the fine mode of about three to seven micrometers and in the coarse mode ranging around approximately 35 micrometers. The fine mode precipitate was identified as tantalum carbide by x-ray analysis.

EXAMPLE 2 (COMPARATIVE)

In a comparative experiment, a composite material was made by melting a sample of a mixture of 67.7 percent by weight aluminum, 30.6 percent by weight tantalum, and 1.7 percent by weight elemental carbon. The sample was heated to 1200 degrees Celsius in an aluminum oxide crucible and maintained at that temperature for one to two hours to assure complete reaction.

The resulting composite material was characterized in detail by melt spinning a sample ribbon for examination by x-ray diffraction and scanning electron microscopy. The x-ray diffraction results comfirmed the presence of tantalum carbide and tantalum aluminide. Neither aluminum carbide nor any ternary carbide was observed.

Scanning electron micrographs of an electropolished and etched cross-section from this sample showed both coarse and fine precipitates were present. Using wavelength dispersive x-ray analysis, the coarse precipitate was identified as tantalum aluminide. The fine precipitate exhibited neglible solubility for aluminum and was rich in tantalum and carbon, indicating that this precipitate was tantalum carbide.

The tantalum aluminide precipitate ranged in size from about 50 micrometers to 150 micrometers, while the tantalum carbide precipitate exhibited a mean size of about five to seven micrometers in a unimodal distribution. Microhardness maasurements on the tantalum aluminide indicated that this precipitate had a hardness of 500 to 600 K.H.N. (Knoop hardness number).

Significant gravity separation of the tantalum carbide phase, as well as of the tantalum aluminide phase, was observed. The gravity separation was greater than that observed in the sample prepared by the process of the present invention as described above.

It will be recognized by those skilled in the art that changes may be made to the above-described embodiments of the invention without departing the broad inventive concepts thereof. It is understood, therefore, that this invention is not limited to the particular embodiments disclosed, but is intended to cover all modifications which are within the scope and spirit of the invention as defined by the appended claims.

We claim:

1. An in situ process for producing a composite with improved homogeneity comprising a refractory material dispersed in a matrix, the process comprising providing a molten composition comprising a matrix liquid;

providing at least one refractory material-forming component selected from the group consisting of refractory boride-forming components and refractory carbide-forming components in the molten composition;

introducing a gas into the molten composition;

providing a reactive component selected from the group consisting of boron containing components and carbonaceous components for reaction with the refractory material-forming component;

whereby the refractory material-forming component reacts with the reactive component in the matrix liquid to form a refractory material dispersed in the matrix liquid; and cooling the liquid composite to form a solid composite material.

2. A process according to claim 1 wherein the gas is introduced into the molten composition under an inert atmosphere.

3. A process according to claim 1 comprising melting a mixture of a matrix solid and a solid refractory material-forming component to provide the molten composition which comprises the matrix liquid and the refractory material-forming component.

4. A process according to claim 1 additionally comprising melting a matrix solid to provide a matrix liquid, and subsequently adding the refractory material-forming component to the matrix liquid to provide the molten composition.

5. A process according to claim 1 wherein the carbonaceous component comprises a carbonaceous solid and wherein the carbonaceous solid is dispersed in the gas which is introduced into the molten composition.

6. A process according to claim 1 wherein the gas comprises the carbonaceous component.

7. A process according to claim 6 wherein the gas additionally comprises an inert carrier gas.

8. A process according to claim 7 wherein the inert carrier gas is argon.

9. A process according to claim 6 wherein the carbonaceous component is selected from carbon monoxide, carbon dioxide, mixtures thereof, and methane.

10. A process according to claim 1 for producing a composite of aluminum and a finely dispersed particulate of a refractory carbide, the composite being substantially free of aluminum carbide, wherein the molten composition comprises molten aluminum and the refractory material-forming component comprises a refractory carbide-forming material.

11. The process of claim 10 wherein the refractory carbide-forming component comprises tantalum.

12. The process of claim 10 wherein the carbonaceous component is a gaseous mixture of argon and methane.

13. The process of claim 10 wherein the refractory carbide-forming component additionally comprises solid tantalum aluminide dispersed in the molten aluminum.

14. A process according to claim 1 wherein the matrix liquid comprises a molten ceramic material.

15. A process according to claim 1 wherein refractory carbide-forming component comprises a transition metal selected from niobium, tantalum, titanium, zirconium, hafnium, molybdenum, vanadium and tungsten.

16. A process according to claim 15 wherein at least a part of the total amount of the transition metal is dissolved in the matrix liquid.

17. A process according to claim 16 wherein the matrix liquid comprises a metallic element and the matrix liquid contains a second phase comprising an intermetallic compound of the metallic element of the matrix liquid and the refractory carbide-forming component.

18. A process according to claim 1 wherein the refractory carbide-forming component is selected from boron and silicon.

19. A process according to claim 1 wherein molten composition additionally comprises elemental carbon and the gas is an inert gas introduced into the molten composition to agitate the molten composition.

20. A process according to claim 19 wherein the refractory carbide-forming component and the elemental carbon are provided in the molten composition in substantially the same amounts on an equivalent weight basis.

21. A process according to claim 20 wherein the matrix liquid is molten aluminum; the refractory carbide-forming component is selected from tantalum, titanium and niobium; and the inert gas is argon.

22. A process according to claim 1 wherein the gas comprises a carbonaceous component and the molten composition additionally comprises elemental carbon.

23. process according to claim 22 wherein the amount of elemental carbon is greater than the amount of the refractory carbide-forming component on an equivalent weight basis.

24. A composite material produced by the process of claim 1 wherein said matrix is a metal.

25. A process according to claim 1 wherein the matrix liquid includes a liquid metal which reacts with the reactive component to form a product having a Gibbs free energy of formation greater than about −10 kilocalories per mole.

26. A process according to claim 25 wherein the liquid metal comprises a molten alloy of nickel and copper.

27. A composite material produced by the process of claim 2 wherein said matrix is a metal.

28. A composite material produced by the process of claim 3 wherein said matrix is a metal.

29. A composite material produced by the process of claim 5 wherein said matrix is a metal.

30. A composite material produced by the process of claim 5 wherein said matrix is a metal.

31. A composite material produced by the process of claim 6 wherein said matrix is a metal.

32. A composite material produced by the process of claim 9 wherein said matrix is a metal.

33. A composite material produced by the process of claim 10.

34. A composite material produced by the process of claim 11.

35. A composite material produced by the process of claim 12.

36. A composite material produced by the process of claim 26.

37. A composite material produced by the process of claim 14 wherein said matrix is a metal.

38. A composite material produced by the process of claim 15 wherein said matrix is a metal.

39. A composite material produced by the process of claim 23.

40. A composite material produced by the process of claim 21.

41. A composite material produced by the process of claim 22 wherein said matrix is a metal.

42. A composite material produced by the process of claim 13.

43. A composite material produced by the process of claim 19 wherein said matrix is a metal.

* * * * *